United States Patent [19]

Fundell

[11] Patent Number: 4,889,071

[45] Date of Patent: Dec. 26, 1989

[54] UPSTREAMS INCLINED DOCTOR BLADE

[75] Inventor: Yngve Fundell, Vallingby, Sweden

[73] Assignee: Oy Wärtsilä AB, Helsinki, Finland

[21] Appl. No.: 33,153

[22] PCT Filed: Jul. 7, 1986

[86] PCT No.: PCT/FI86/00077

§ 371 Date: May 4, 1987

§ 102(e) Date: May 4, 1987

[87] PCT Pub. No.: WO87/00092

PCT Pub. Date: Jan. 15, 1987

[30] Foreign Application Priority Data

Jul. 5, 1985 [SE] Sweden ..... 85033454

[51] Int. Cl.[4] ..... B05C 11/04

[52] U.S. Cl. ..... 118/126; 118/413

[58] Field of Search ..... 118/126, 413

[56] References Cited

U.S. PATENT DOCUMENTS

| | | | |
|---|---|---|---|
| 2,534,320 | 12/1950 | Taylor | 118/126 |
| 3,251,339 | 5/1966 | Whitfield | 118/122 |
| 3,749,054 | 7/1973 | Brezinski | 118/126 |
| 4,220,113 | 9/1980 | Wohlfeil | 118/126 |
| 4,331,713 | 5/1982 | Girard | 118/413 X |

*Primary Examiner*—Shrive Beck

*Assistant Examiner*—Alain Bashore

*Attorney, Agent, or Firm*—Dellett, Smith-Hill & Bedell

[57] ABSTRACT

An arrangement for the coating of a running cardboard, paper or the like web (1) by coating paste, whereby an excess amount of the supplied paste is removed and the supplied coating layer is levelled by means of a scraper knife (6) separately arranged after the coating position in the running direction of the web (1). The scraper knife (6) is arranged upstream, inclined relative to the running web (1) so, that the web (1) meets the knife (6) in an angle, which exceeds 90°, preferably considerably exceeds 90°.

6 Claims, 3 Drawing Sheets

UPSTREAMS INCLINED DOCTOR BLADE

BACKGROUND OF THE INVENTION

The invention relates to an arrangement for the coating of a running web.

Paper, cardboard etc. are normally produced from natural cellulose fiber. The paper production is a complicated process, which is started by the defibration of natural logs or other plant parts, fibre preparation and finally sheet formation. In the sheet formation one strives to distribute the fibers evenly as possible. Along with the dewatering, which is carried out by the sheet formation, the fibers are guided more near to each other and are linked, mainly through fluidum bonds.

The paper comprises fibres located in several layers, arbitrarily distributed. If one examines the paper through a magnifying glass, cavities are found between the fibers and the surface is found uneven—everything depending on the micro structure quoted above.

One might have different reasons for the desire to improve this uneven micro structure. One might have, for instance, the desire to reduce the porosity in the paper, in order to be able to apply it as packaging material. Or, it is also important to improve the paper surface itself, in order to be able to print on the paper with a good result. A common method for the surface levelling and the porosity reducing is the application of a layer on the top of the completed paper surface. A normal method is to mix finely divided pigment, for instance clay, with water along with some binding substance, for instance latex, and thereafter to supply this paste on the paper web. The surface smoothness is achieved by doctoring the paste by a trowel blade, a so called scraper knife. The doctored paper is hereafter dried, whereby the supplied paste is attached at the paper web through a certain penetration.

A scraper blade has been used for doctoring-levelling from the realization of the coating technique onwards. Since the dominating technique is based on the principle, in which the scraper knife doctors the excess amount of the paste, the motion pattern of the paste will become complicated in the gap between the scraper and the paper, especially because very high speeds are used in the coating. A normal method comprises the guiding of the paper web over a standstill, downstreams inclined scraper knife. Normal speeds are 600–1000 m/min, but even higher speed up to 2000 m/min are applied. The excess paste amount in the coating can be 10–20 ggr. This excess amount is forced in to the space between the scraper knife and the paper back-up drum, and leaves this space by flowing transversely relative to the knife, and is thereafter resupplied to a trough for a re-entry in to the machine bin. During the reflow over the knife, the re-entried paste meets that paste, which is guided along with the paper against the knife.

Several problems occur during the paste levelling by the up-to-now used "downstreams inclined" scraper knife, which are related to the complicated motion pattern at the gap between the knife and the back-up drum (paper). This reveales itself in rheology phenomena, that is, the paste alters characteristics. The viscosity is diminished or increased, a uncontrolled dewatering occurs, and so on. This might result in its being impossible to achieve an even paste coating, or that the paste is not levelled at the phase edge of the scraper knife, that is, a so-called "bleeding" occurs. The paste might also be dewatered soon under the phase edge of the scraper knife, as of which the dewatered pigment attached to the knife.

SUMMARY OF THE INVENTION

The object of the invention is to provide an arrangement for the paste levelling which eliminates the defects of the prior art described earlier. The invention is characterized in that the coating paste levelling is carried out by a "upstreams inclined" scraper knife, which replaces "downstreams inclined" scraper knives of coventional type. By this means that benefit is created, that no such rheology phenomenon is generated, which can exist in the space, that is located between the scraper knife and the back-up in the "downstreams inclined" embodiment.

Furthermore, a free exit is available for the supplied excess paste amount.

During the driving of a straight blade according to the "upstreams inclined" embodiment, the scraper knife must be produced from a stable material and having a distinctive adjustment of the blade distance.

That paste "packaging" which is generated by the "downstreams inclined"embodiment is entirely eliminated in the "upstreams inclined" method. This results in benefits in the form of increased capillary volume in the coating layer, which results in an improved printing result.

It is also possible by means of this quoted method to coat by a "bent-blade". The blade tip is hereby compressed in to a position, which is parallel to the paper web or due to the curvature of the back-up drum or the knife) hereby a small space is created between the paper and the scraper knife. This space apparently increases the paste "packing", but will also result in an increased coating when compared to a straight blade.

When the coating is carried out by a "bent blade" and a "upstreams inclined" scraper blade, one applies the common flexible scraper steel. By this means the blade pressure can be regulated through ususal measures for the compensation of the irregularities in the paper profile, humidity streaks etc.

During a blade coating by the "downstreams inclined" scraper knife one cannot proceed with a too high dry content in the paste. In that case a "dry bleeding" will occur resulting in so-called blade scars. With a coating using the "upstreams inclined" scraper knife, the paste dry content can be increased without resulting in "dry bleeding".

BRIEF DESCRIPTION OF THE DRAWING

The invention is described more in detail with reference to the attached drawing, in which.

DESCRIPTION OF THE PREFERRED EMBODIMENTS

Figure 1:
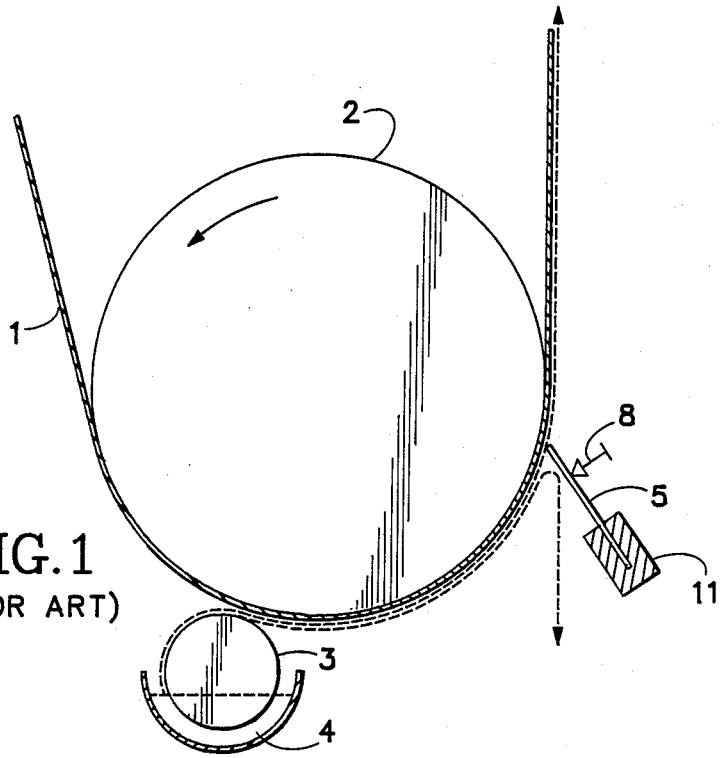
FIG. 1 (PRIOR ART)
FIG. 1 illustrates schematically a downstreams inclined scraper knife of conventional type as a side view.

According to the drawing a running cardboad, paper or the like web 1 is guided over a guide drum 2, whereby coating paste is supplied on web 1 by means of a rotatable coating drum 3, which receives coating paste from a machine bin 4. The amount of the coating paste which is supplied on the web is hereby quite big, which ensures that the entire surface of the web will be coated. The supplied coating paste follows along with the running web to a levelling scraper knife 5, 6, 7, which is located at a certain distance from the supply position and is supported by a scraper knife support member 11.

According to the conventional technique (FIG. 1), scraper knife 5 is downstreams inclined, that is, the web arrives at the knife in an angle, which is less than 90°. By means of a profile adjustment 8 one realizes the desired gap and pressure between the knife and the web. The excess paste amount flows in the re-entry over the knife from which it will be collected in a trough (not illustrated) for resupply in to machine bin 4. A rheology phenomen related to those quoted earlier is easily generated at the chamfer edge of the scraper knife, "bleeding" uncontrollable paste dewatering and so on.

Figure 2:
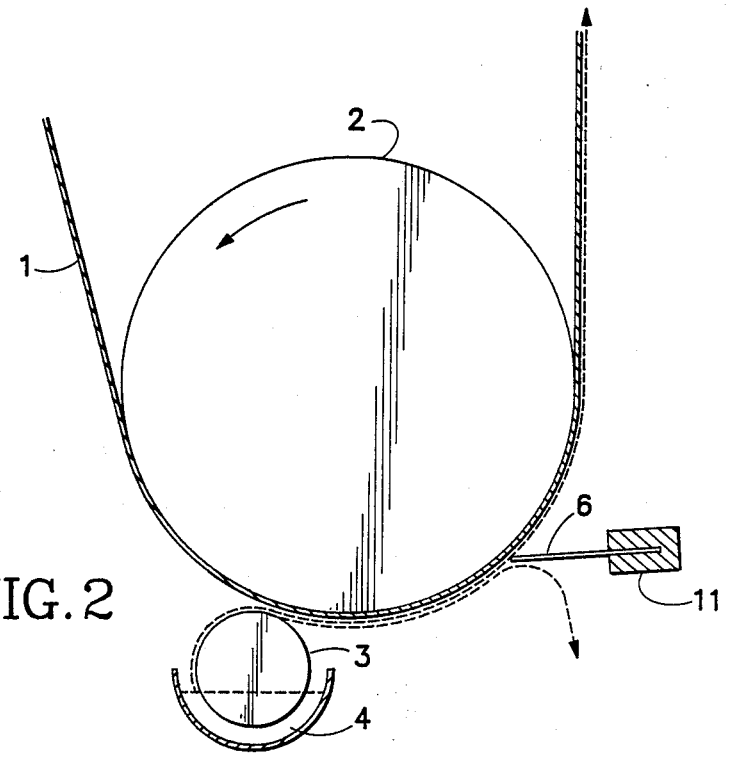
FIG. 2 illustrates schamatically an embodiment of the invention as a side view.

FIG. 2 illustrates an embodiment of a upstreams inclined scraper knife 6 according to the invention. The web arrives at scraper knife 6 in an angle, which is considerable higher than 90°. The scraper knife "peels" hereby off the excess paste amount, in contrast to prior art, in which the excess paste amount is compressed away. The production material of knife 6 and the adjustment mechanism can in coarse terms correspond the conventional technique, however, the knife material should generally be somewhat more stable and stiff, as well as the requirements for the adjustment of blade distance and pressure are more distinctive in the embodiment of the invention. The knife chamfer edge is preferably slightly rounded for avoiding damages in the running web.

The paste excess amount has a free exit in the construction according to FIG. 2. The paste "packing" occuring in conventional techniques is hereby entirely eliminated.

Figure 3:
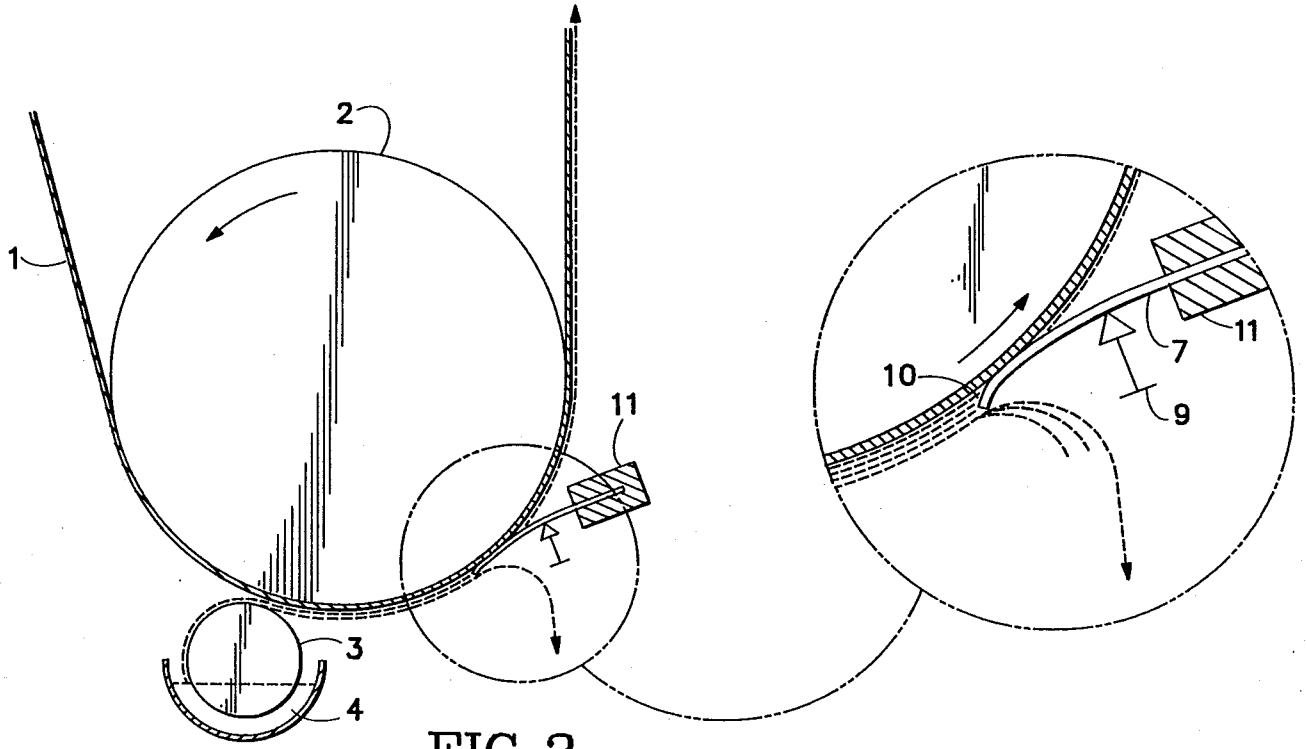
FIG. 3 illustrates schematically another embodiment of the invention, including an enlargement of a detail, as a side view, also.

According to another embodiment of the invention (FIG. 3), this one is applied for a so-called bent blade, that is, a scraper knife of higher flexible design, the blade tip of which is compressed in to a position, which is mainly parallel to running web 1. According to a modification of this embodiment a small space 10 at the location, where the web meets the knife, is created between the web and the scraper knife. This space generates hereby a certain paste "packing", it is, however important that the excess paste amount is "peeled-off" to an-essential extent by the knife, without allowing rheology phenomena to occur. Profile adjustment mechanism 9 in this embodiment is also designed according to the technique familiar in downstreams inclined scraper knifes.

The invention is not limited to the embodiments shown, but several modifications and variations thereof are feasible within the scope of the attached claims. The coating can, for instance, be carried out by means of applicators instead of the quoted machine bin. The invention can also be applied for a simultaneous two-sided coating of a running web. Guide drum 2 can be replaced by a smaller back-up drum located at the opposite web side relative to the scraper knife. In an application especially of the so-called bent blade, two scraper knives can be arranged at opposite sides of the running web in the two-sided coating, which hereby generates the necessary support for each other.

I claim:

1. An arrangement for coating a running web of cardboard, paper, or like material with coating paste, comprising:

means defining a path of movement for the web, a scraper knife support member, and a scraper knife supported by the scraper knife support member and projecting towards said path of movement, the scraper knife being arranged so that it is inclined upstream relative to the path of movement of the web and the web meets the knife at an angle greater than 90°, the scraper knife being flexible and having a tip region that engages the web and is disposed substantially parallel to the running direction of the web.

2. An arrangement according to claim 1, comprising means for application of pressure to the scraper knife for adjusting the pressure with which the knife engages the web.

3. An arrangement according to claim 1, wherein the means defining a path of movement for the web comprise a drum.

4. An arrangement according to claim 1, wherein the means defining a path of movement for the web comprise a rotatable drum.

5. An arrangement according to claim 1, wherein a space is created between the tip of the knife and the web.

6. An arrangement according to claim 1, comprising a machine bin and a rotatable applicator drum for applying coating paste to the web.

* * * * *